US008331827B2

(12) United States Patent
Kurosu

(10) Patent No.: US 8,331,827 B2
(45) Date of Patent: Dec. 11, 2012

(54) IMAGE FORMING APPARATUS TO CONTROL BELT POSITION

(75) Inventor: Tetsuko Kurosu, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 247 days.

(21) Appl. No.: 12/745,567

(22) PCT Filed: Jul. 9, 2009

(86) PCT No.: PCT/JP2009/062496

§ 371 (c)(1),
(2), (4) Date: Jun. 1, 2010

(87) PCT Pub. No.: WO2010/007928

PCT Pub. Date: Jan. 21, 2010

(65) Prior Publication Data

US 2010/0303495 A1 Dec. 2, 2010

(30) Foreign Application Priority Data

Jul. 16, 2008 (JP) ..... 2008-185013
Jul. 16, 2008 (JP) ..... 2008-185020

(51) Int. Cl.
*G03G 15/20* (2006.01)

(52) U.S. Cl. ..... 399/122

(58) Field of Classification Search ..... 399/122, 399/68, 322, 329
See application file for complete search history.

(56) References Cited

U.S. PATENT DOCUMENTS

| | | | |
|---|---|---|---|
| 5,027,160 | A | 6/1991 | Okada et al. |
| 2006/0083562 | A1 | 4/2006 | Matsumoto et al. |
| 2008/0003028 | A1 | 1/2008 | Kuroki et al. |

FOREIGN PATENT DOCUMENTS

| | | | |
|---|---|---|---|
| EP | 0372558 | A2 | 6/1990 |
| JP | 2-157880 | A | 6/1990 |
| JP | 3-25477 | A | 2/1991 |
| JP | 5-61373 | A | 3/1993 |
| JP | 5-30854 | U | 4/1993 |
| JP | 8-262903 | A | 10/1996 |
| JP | 9-288432 | A | 11/1997 |
| JP | 2006-146154 | A | 6/2006 |

(Continued)

OTHER PUBLICATIONS

International Search Report for International application No. PCT/JP2009/062496 with English translation mailed Aug. 18, 2009.
Notification of Reasons for Refusal for Japanese Patent Application No. 2008-185020 with English translation mailed Aug. 11, 2009.
Notification of Reason for Refusal for Japanese Patent Application No. 2008-185020 with English translation mailed Apr. 20, 2010.

(Continued)

*Primary Examiner* — Quana M Grainger
(74) *Attorney, Agent, or Firm* — Cantor Colburn LLP

(57) ABSTRACT

Provided is an image forming apparatus comprising a secondary transfer belt disposed at a position to face an intermediate transfer belt across the transfer passage of paper (P), a fixing belt disposed on the down-stream side of the secondary transfer belt in the transfer direction of the paper (P) and at a position to face a rotary fixing member across the transfer passage of the paper (P), a photo sensor for detecting the widthwise position of the fixing belt, a steering roller angle changing unit for making the rolling angle of a steering roller changeable, and a first control unit for controlling a stepping motor on the basis of the signal of the photo sensor. The control unit does not perform the angle change of the steering roller, if the paper is constricted by both a transfer nip and a fixing nip.

7 Claims, 14 Drawing Sheets

FOREIGN PATENT DOCUMENTS

| | | | |
|---|---|---|---|
| JP | 2007-212865 | A | 8/2007 |
| JP | 2008-33228 | A | 2/2008 |
| JP | 2008-52200 | A | 3/2008 |

OTHER PUBLICATIONS

Notification of Reason for Refusal for Japanese Patent Application No. 2008-185013 with English translation mailed Aug. 11, 2009.

*FIG.7*

| ON/OFF OF LIGHT RECEIVING ELEMENT | R1 | OFF | ON | ON | ON |
|---|---|---|---|---|---|
| | R2 | OFF | OFF | ON | ON |
| | R3 | OFF | OFF | OFF | ON |
| POSITION OF BELT | | A1 | A2 | A3 | A4 |

FIG.8A

| POSITION OF BELT | CHANGE IN ROTATION ANGLE OF STEERING ROLLER | |
|---|---|---|
| | WITHOUT PAPER RESTRAINT | WITH PAPER RESTRAINT |
| A1 | -4 LEVELS | 0 |
| A2 | -2 LEVELS | 0 |
| A3 | +2 LEVELS | 0 |
| A4 | +4 LEVELS | 0 |

FIG.8B

| CHANGE IN ROTATION ANGLE OF STEERING ROLLER | AXIS ANGLE [DEGREES] |
|---|---|
| -4 LEVELS | -2 |
| -2 LEVELS | -1 |
| 0 | 0 |
| +2 LEVELS | 1 |
| +4 LEVELS | 2 |

FIG.10A

| POSITION OF BELT | CHANGE IN ROTATION ANGLE OF STEERING ROLLER | | |
|---|---|---|---|
| | WITHOUT PAPER RESTRAINT | WITH PAPER RESTRAINT IN EITHER ONE OF NIPS | WITH PAPER RESTRAINT IN BOTH NIPS |
| A1 | -4 LEVELS | -2 LEVELS | -1 LEVELS |
| A2 | -2 LEVELS | -1 LEVELS | 0 |
| A3 | +2 LEVELS | +1 LEVELS | 0 |
| A4 | +4 LEVELS | +2 LEVELS | +1 LEVELS |

FIG.10B

| CHANGE IN ROTATION ANGLE OF STEERING ROLLER | AXIS ANGLE [DEGREES] |
|---|---|
| -4 LEVELS | -2 |
| -2 LEVELS | -1 |
| -1 LEVELS | -0.5 |
| 0 | 0 |
| +1 LEVELS | 0.5 |
| +2 LEVELS | 1 |
| +4 LEVELS | 2 |

IMAGE FORMING APPARATUS TO CONTROL BELT POSITION

CROSS REFERENCE TO RELATED APPLICATIONS

This is a U.S. national stage application of International Application No. PCT/JP2009/062496, filed on 9 Jul. 2009. Priority under 35 U.S.C. §119(a) and 35 U.S.C. §365(b) is claimed from Japanese Application No. JP2008-185013, filed 16 Jul. 2008 and from Japanese Application No. JP2008-185020, filed 16 Jul. 2008, the disclosures of which are also incorporated herein by reference.

TECHNICAL FIELD

The present invention relates to an image forming apparatus.

BACKGROUND ART

There is known an image forming apparatus which transfers toner supported on an image carrier such as a photoreceptor, an intermediate transfer body or the like onto a paper in a transfer unit and which fixes the toner transferred onto the paper by thermal fixing in a fixing unit.

In FIG. 13, an outline of a transfer unit 210 and a fixing unit 220 of a conventional image forming apparatus 200 is shown.

The transfer unit 210 comprises a photoreceptor drum 211 to support toner, a transfer belt 212 and rollers 213,214 and 215. The photoreceptor drum 211 and the roller 213 are disposed so that the outer circumferences thereof face each other across the conveyance passage of a paper P. A paper P is nipped between the photoreceptor drum 211 and the transfer belt 212 at the facing part of the photoreceptor drum 211 and the roller 213 to be conveyed in the direction of the arrow. In this conveyance process, the toner image on the photoreceptor drum 211 is transferred onto the paper P.

The fixing unit 220 comprises a fixing roller 221 having a heat source, a fixing belt 222 and rollers 223, 224 and 225. The fixing roller 221 and the roller 223 are disposed so that the outer circumferences thereof face each other across the conveyance passage of the paper P. The paper P is nipped between the fixing roller 221 and the transfer belt 222 at the facing part of the fixing roller 221 and the roller 223 along to the upstream side in the conveyance direction of the paper P to be conveyed in the direction of the arrow. In this conveyance process, the toner image on the paper P is fixed by thermal fixing by the fixing roller 221.

The transfer belt 212 and the fixing belt 222 are activated by each of the rollers provided within each of the rings being driven. There is a possibility that position displacement occurs in the widthwise position of the belt with the activation of each belt. The position displacement may cause twisting, rippling and the like of the belt and may cause various types of poor conditions such as poor contact between the photoreceptor drum 211 and the paper P and between the fixing roller 221 and the paper P, drifting of image, roughness in brightness and the like. In order to prevent such poor conditions, a structure for inhibiting or correcting the position displacement is provided in the image forming apparatus. For example, there is a structure to inhibit position displacement of the belt by having guide members provided at both side portions of the widthwise position of each belt (for example, patent document 1). Alternatively, there is a structure where any one of the rollers within the ring of each belt is provided so that the angle thereof with respect to the belt can be changed and where the widthwise position of the belt can be controlled by guiding by changing the angle (for example, patent document 2).

Among the above structures, in a case of the structure where the position displacement of the widthwise position of the belt is inhibited by the guide members as in patent document 1, there is a possibility that the position displacement occurs by the belt going over the guide members when the position of the belt is greatly displaced. Therefore, when the position control of the belt is preferred to be carried out surely, the structure to carry out a control of the widthwise position of the belt by carrying out the angle control of the roller as in patent document 2 is applied.

Recently, due to the downsizing of image forming apparatus, there is an image forming apparatus where a space E between the position where a paper P is nipped by the transfer unit 210 (hereinafter, called "transfer nip") and the position where the paper P is nipped by the fixing unit 220 (hereinafter, called "fixing nip") is made to be smaller than the width of the paper P in the conveyance direction. In such image forming apparatus, there is a timing when the paper P is nipped by both of the transfer nip and the fixing nip. When the control of the widthwise position of each belt by the angle of the roller is carried out when the paper P is nipped by both of the transfer nip and the fixing nip, there is a possibility that distortion occurs in the paper P. Hereinafter, the distortion will be described with reference to FIG. 14.

In FIG. 14, an example of a case where distortion occurs in the paper P is shown. The paper P is nipped by the transfer unit 210 at the position of transfer nip G and is nipped by the fixing unit 220 at the position of fixing nip H. At this time, when the control of position is carried out in different directions for the transfer belt 212 and the fixing belt 212, the paper P is to be pulled in opposite directions from each other at the position of transfer nip G and at the position of fixing nip H, and distortion occurs at the portion between the transfer nip G and the fixing nip H. The distortion causes various types of poor conditions in the image forming and deterioration in quality of the image forming such as causing a poor fixation of toner and further causing wrinkles on the paper by the paper P being nipped by the fixing unit 220 in the distorted condition.

Given this fact, there is a structure to inhibit the angle control of the roller to correct the position displacement of the belt when the paper is at the fixing unit (for example, patent document 3).

Patent document 1: Japanese Patent Application Laid-Open Publication No. 3-25477

Patent document 2: Japanese Patent Application Laid-Open Publication No. 8-262903

Patent document 3: Japanese Utility Model Application Laid-Open Publication No. 5-30854

DISCLOSURE OF THE INVENTION

Problem to be Solved by the Invention

However, when the structure of patent document 3 is applied, there is a possibility that productivity of the image forming apparatus is reduced. That is because, when the position displacement of the belt occurs to a level where poor conditions occur in the image forming, transferring and fixing to the paper need to be temporarily halted and the control of position of the belt needs to be carried out even in the middle of the image forming process to a paper. In particular, when carrying out a process such as continuously forming images on a plurality of papers, productivity of the image forming apparatus is greatly reduced due to temporarily halting the process.

An object of the present invention is to provide an image forming apparatus in which distortion of paper does not occur and which has high productivity.

Means for Solving the Problem

According to at least an embodiment of the invention, there is provided an image forming apparatus comprising a transfer unit having a transfer nip, which is provided in an upstream side of a conveyance direction of a paper, a fixing unit having a fixing nip of a fixing belt, which is provided in a downstream side of the conveyance direction, a fixing belt position changing mechanism unit to change a widthwise position of the fixing belt and a control unit to control the fixing belt position changing mechanism unit according to the widthwise position of the fixing belt, and the control unit does not perform a change of the widthwise position of the fixing belt when the paper is nipped by both of the transfer nip of the transfer unit and the fixing nip of the fixing unit at a same time.

According to at least an embodiment of the invention, there is provided the image forming apparatus, wherein the fixing belt position changing mechanism unit includes a first steering roller to extend the fixing belt and the fixing belt position changing mechanism unit changes the widthwise position of the fixing belt by changing a rotation angle of the first steering roller.

According to at least an embodiment of the invention, there is provided the image forming apparatus, comprising the transfer unit having the transfer nip of a transfer belt and a transfer belt position changing mechanism unit to change a widthwise position of the transfer belt, and when the paper is nipped by both of the transfer nip of the transfer unit and the fixing nip of the fixing unit at the same time, the control unit does no perform a change of the widthwise position of the transfer belt.

According to at least an embodiment of the invention, there is provided the image forming apparatus, wherein the transfer belt position changing mechanism unit includes a second steering roller to extend the transfer belt and the transfer belt position changing mechanism unit changes the widthwise position of the transfer belt by changing a rotation angle of the second steering roller.

According to at least an embodiment of the invention, there is provided the image forming apparatus, wherein the transfer unit includes the transfer nip of a transfer roller.

According to at least an embodiment of the invention, there is provided an image forming apparatus comprising a transfer unit having a transfer nip, which is provided in an upstream side of a conveyance direction of a paper, a fixing unit having a fixing nip of a fixing belt, which is provided in a downstream side of the conveyance direction, a fixing belt position changing mechanism unit to change a widthwise position of the fixing belt and a control unit to control the fixing belt position changing mechanism unit according to the widthwise position of the fixing belt, and the control unit makes a change in the widthwise position of the fixing belt so as to be different between when the paper is nipped by both of the transfer nip of the transfer unit and the fixing nip of the fixing unit at a same time and when the paper is not nipped by both of the transfer nip and the fixing nip at the same time.

According to at least an embodiment of the invention, there is provided the image forming apparatus, wherein when the paper is nipped by both of the transfer nip of the transfer unit and the fixing nip of the fixing unit at the same time, the control unit makes the change in the widthwise position of the fixing belt so as to be smaller than that of when the paper is not nipped by both of the transfer nip and the fixing nip at the same time.

According to at least an embodiment of the invention, there is provided the image forming apparatus, wherein the control unit makes the change in the widthwise position of the fixing belt so as to be different between when the paper is nipped by either one of the transfer nip of the transfer unit or the fixing nip of the fixing unit and when the paper is not nipped by either of the transfer nip of the transfer unit and the fixing nip of the fixing unit.

According to at least an embodiment of the invention, there is provided the image forming apparatus, wherein when the paper is nipped by either one of the transfer nip of the transfer unit or the fixing nip of the fixing unit, the control unit makes the change in the widthwise position of the fixing belt so as to be smaller than that of when the paper is not nipped by either of the transfer nip of the transfer unit and the fixing nip of the fixing unit.

According to at least an embodiment of the invention, there is provided the image forming apparatus, wherein the fixing belt position changing mechanism unit includes a first steering roller to extend the fixing belt and the fixing belt position changing mechanism unit changes the widthwise position of the fixing belt by changing a rotation angle of the first steering roller.

According to at least an embodiment of the invention, there is provided the image forming apparatus comprising the transfer unit having the transfer nip of a transfer belt and a transfer belt position changing mechanism unit to change a widthwise position of the transfer belt, and the control unit makes a change in the widthwise position of the transfer belt so as to be different between when the paper is nipped by both of the transfer nip of the transfer unit and the fixing nip of the fixing unit at the same time and when the paper is not nipped by both of the transfer nip and the fixing nip at the same time.

According to at least an embodiment of the invention, there is provided the image forming apparatus, wherein when the paper is nipped by both of the transfer nip of the transfer unit and the fixing nip of the fixing unit at the same time, the control unit makes the change in the widthwise position of the transfer belt so as to be smaller than that of when the paper is not nipped by both of the transfer nip and the fixing nip at the same time.

According to at least an embodiment of the invention, there is provided the image forming apparatus, wherein the control unit makes the change in the widthwise position of the transfer belt so as to be different between when the paper is nipped by either one of the transfer nip of the transfer unit or the fixing nip of the fixing unit and when the paper is not nipped by either of the transfer nip of the transfer unit and the fixing nip of the fixing unit.

According to at least an embodiment of the invention, there is provided the image forming apparatus, wherein when the paper is nipped by either one of the transfer nip of the transfer unit or the fixing nip of the fixing unit, the control unit makes the change in the widthwise position of the transfer belt so as to be smaller than that of when the paper is not nipped by either of the transfer nip of the transfer unit and the fixing nip of the fixing unit.

According to at least an embodiment of the invention, there is provided the image forming apparatus, wherein the transfer belt position changing mechanism unit includes a second steering roller to extend the transfer belt and the transfer belt position changing mechanism unit changes the widthwise position of the transfer belt by changing a rotation angle of the second steering roller.

According to at least an embodiment of the invention, there is provided the image forming apparatus, wherein the transfer unit includes the transfer nip of a transfer roller.

Advantageous Effect of the Invention

According to the present invention, an image forming apparatus in which distortion of paper does not occur and which has high productivity can be provided.

BRIEF DESCRIPTION OF THE DRAWINGS

[FIG. 7] This is a correspondence table of exist/non-exist patterns of light detection by light receiving elements R1 to R3 of the photo sensor and widthwise position of the fixing belt shown in FIG. 6.

[FIG. 8A] This is a table showing a steering control amount table of the first embodiment.

[FIG. 8B] This is a table showing correspondence relation between steering roller control amount in the steering control amount table of the first embodiment and axis angle of the steering roller.

[FIG. 10A] This is a table showing a steering control amount table of the second embodiment.

[FIG. 10B] This is a table showing a correspondence relation between steering roller control amount in the steering control amount table of the second embodiment and axis angle of the steering roller.

BEST MODE FOR CARRYING OUT THE INVENTION (First Embodiment)

Hereinafter, an example of embodiments of the present invention will be described with reference to the drawings.

Figure 1:
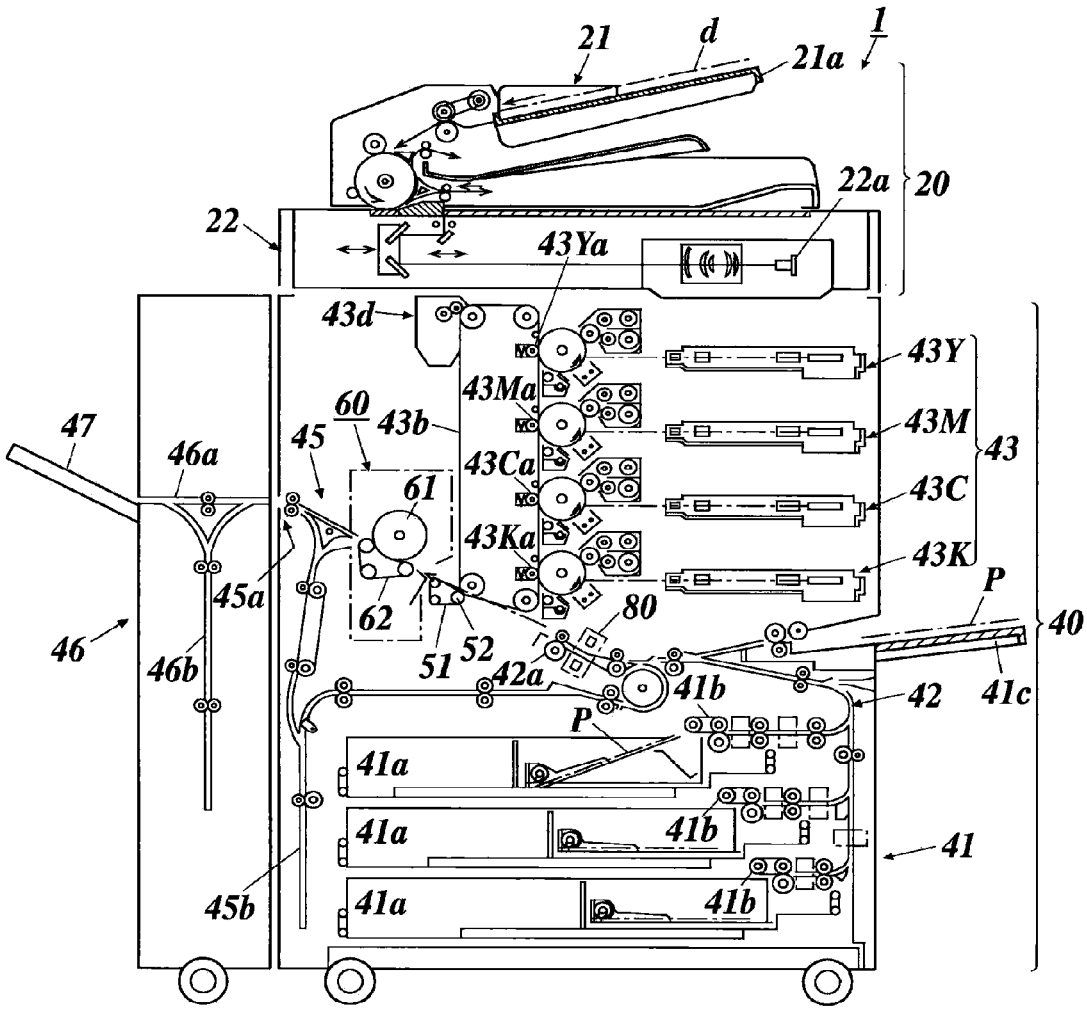
[FIG. 1] This is a schematic cross sectional diagram of an image forming apparatus according to the first embodiment.

In FIG. 1, a schematic cross sectional diagram of an image forming apparatus 1 according to the first embodiment is shown.

As shown in FIG. 1, the image forming apparatus 1 is provided with a copy function where an image is read from a document and the read image is formed on a paper P and outputted, a print function where page data including image data and a job including image forming condition and the like of each image data are received from an external device and the like and where an image is formed on a paper P based on the received job and outputted and the like. As shown in FIG. 1, the image forming apparatus 1 comprises an image reading unit 20, a print unit 40 and the like.

The image reading unit 20 comprises an automatic document feeding unit 21 which is called ADF (Auto Document Feeder) and a reading unit 22. A document d which is mounted on a document tray 21*a* of the automatic document feeding unit 21 is conveyed to a contact glass which is the reading place, images on one side or both sides of the document d is read by an optical system and the images of the document d are read by the CCD (Charge Coupled Device) 22*a*. Here, image is not limited to image data such as graphics, photographs and the like, and image includes text data such as letters, symbols and the like.

The image (analog image signal) which is read by the image reading unit 20 is outputted to the after-mentioned control unit 90, and the read image is outputted to the print unit 40 after various types of image processes such as A/D conversion and the like are carried out to the image in the control unit 90.

The print unit 40 carries out an image forming process of electrographic based on inputted print data, and the print unit 40 comprises a paper feeding unit 41, a conveyance unit 42, an image forming unit 43, a fixing unit 60, a discharging unit 45 and a discharge stand-by unit 46.

The paper feeding unit 41 comprises a plurality of paper feeding trays 41*a* and paper feeding sections 41*b*, a manual bypass tray 41*c* and the like. In the paper feeding trays 41*a*, papers P such as standard papers, specialty papers, insertion papers and the like which are identified based on basis weight, size and the like of the papers are housed according to predetermined types in each paper feeding tray 41*a*, and the paper P is conveyed toward the conveyance unit 42 one by one from the top by the paper feeding sections 41*b*. The manual bypass tray 41*c* is a paper feeding tray which can mount various types of paper P according to a user's needs, and the mounted paper P is conveyed toward the conveyance unit 42 one by one from the top by the paper feeding roller.

The conveyance unit 42 conveys the paper P which is conveyed from a paper feeding tray 41*a* or the manual bypass tray 41*c* to a secondary transfer belt 51 via a plurality of intermediate rollers, a resist roller 42*a* and the like. The resist roller 42*a* functions as a first stand-by unit to make the paper which is to be conveyed to the secondary transfer belt 51 stand by temporarily, and the secondary transfer belt 51 functions as a secondary transfer unit to secondarily transfer the toner image on the intermediate transfer body (intermediate transfer belt 43*b*) onto the paper.

Moreover, the conveyance unit 42 conveys the paper P to which one-side image forming process is already carried out to a both-side conveyance passage by a conveyance passage switching board, and the conveyance unit 42 conveys the paper P to the secondary transfer belt 51 again via the intermediate rollers and the resist roller 42*a*. By the secondary transfer belt 51, the toner image which is primary-transferred on the intermediate transfer belt 43*b* is secondary-transferred onto the paper P.

For example, when forming an image of four colors (yellow (Y), magenta (M), cyan (C) and black (K)), the image forming unit 43 comprises image forming units 43Y, 43M, 43C and 43K for each of the colors in which toner of different colors can be filled respectively, the intermediate transfer belt 43*b* and a cleaning unit 50.

For example, the image forming unit 43Y comprises a charging device, an exposure device, a development device, a primary transfer roller 43Ya which functions as a primary transfer unit to primary-transfer the toner image which is formed by an electrostatic latent image based on the image data being developed and a cleaning device which are disposed at circumference of the photoreceptor drum, and the image forming unit 43Y forms an image of yellow(Y).

In particular, an electrostatic latent image is formed by irradiating a light according to image data of yellow (Y) from the exposure device to the photoreceptor drum which is charged by the charging device. Then, the development device develops the electrostatic latent image by attaching yellow (Y) toner which is charged on the surface of the photoreceptor drum on which the electrostatic latent image is formed. By the photoreceptor drum to which toner is attached by the development device being rotated at a constant speed to a transfer position where the primary transfer roller 43Ya is disposed, the primary-transfer is carried out to the intermediate transfer belt 43*b*. After the toner is primary-transferred to the intermediate transfer belt 43*b*, the cleaning device removes residual electric change, residual toner and the like on the surface of the photoreceptor drum.

The image forming units 43M, 43C and 43K comprise structures similar to the structure of the image forming unit 43Y and respectively form images of magenta (M), cyan (C) and black (K).

The intermediate transfer belt 43*b* is a semiconductive endless belt which is extended between a plurality of rollers and which is rotatably supported, and the intermediate transfer belt 43*b* is driven and moves with the rotation of rollers such as driving rollers.

The intermediate transfer belt 43*b* is made to pressure-contact each of the photoreceptor drums, respectively, by the primary transfer rollers 43Ya, 43Ma, 43Ca and 43Ka of each image forming unit 43Y, 43M, 43C and 43K. In such way, each toner developed on the surface of each photoreceptor drum is primary-transferred to the intermediate transfer belt 43*b* at the transfer position of each of the primary transfer rollers 43Ya, 43Ma, 43Ca and 43Ka. Further, secondary-transfer is carried out by orderly superimposing each toner of yellow, magenta, cyan and black on the paper P at the transfer position of the secondary transfer roller 52. The secondary transfer roller 52 functions as a secondary transfer unit to secondary-transfer the toner image which is primary-transferred to the intermediate transfer belt 43*b* onto the paper P.

Then, the intermediate transfer belt 43*b* separates the paper P curvaturely and electrostatically and the cleaning unit 43*d* removes the residual toner after the toner image is secondary-transferred onto the paper P by the secondary transfer roller 52.

In the fixing unit 60, the rotary fixing member 61 having a heat source 61*a* and the fixing belt 62 which forms a fixing nip H1 (see FIG. 3) by pressure-contacting the rotary fixing member 61 carries out thermal fixing of the toner image which is secondary-transferred onto the paper P.

The discharging unit 45 comprises a plurality of paper ejection rollers, an exit 45*a* and an ejection side switching passage 45*b*. The discharging unit 45 discharges the paper P to which the toner image is fixed out to the discharge stand-by unit 46 from the exit 45*a* by sandwiching the paper P between the paper ejection rollers, and further, discharges the paper P to which the toner image is fixed to the discharge stand-by unit 46 from the exit 45*a* after conveying the paper P to the ejection side switching passage 45*b* which functions as the ejection side switching unit to switch the sides of paper to be ejected out to the discharge stand-by unit 46 by sandwiching the paper P between the paper ejection rollers by the conveyance passage switching board.

The discharge stand-by unit 46 is provided between the secondary transfer roller 42*b* and the paper ejection tray 47, and the discharge stand-by unit 46 comprises a plurality of paper ejection rollers, the first discharging passage 46*a* and the second discharging passage 46*b*. After conveying the paper which entered from the exit 45*a* to the first discharging passage 46*a* or the second discharging passage 46*b* by the conveyance passage switching board, the discharge stand-by unit 46 ejects the paper to the paper ejection tray 47.

The first discharging passage 46*a* is a passage to eject the paper which entered from the exit 45*a* to the paper ejection tray 47 in a same side as the paper surface when the paper was entered from the exit 45*a*. The second discharging passage 46*b* functions as the second stand-by unit to make the paper which entered from the exit 45*a* stand by temporarily, and is a passage to eject the paper to the paper ejection tray 47 at a predetermined timing and is a passage to eject the paper out to the paper ejection tray 47 in the side opposite to the paper surface when the paper was discharged to the paper ejection tray 47 via the first discharging passage 46*a*.

In upstream of the secondary transfer belt 51 in the conveyance direction of paper P, a paper position detection unit 80 to recognize the position of paper P is provided. When the paper position detection unit 80 detects passing of paper P which is conveyed at the conveyance unit 42, the paper position detection unit 80 outputs a signal (hereinafter, called detection signal) indicating the detection of paper P. The detection signal is inputted to the after-mentioned control unit 90 (see, FIG. 2).

Figure 2:
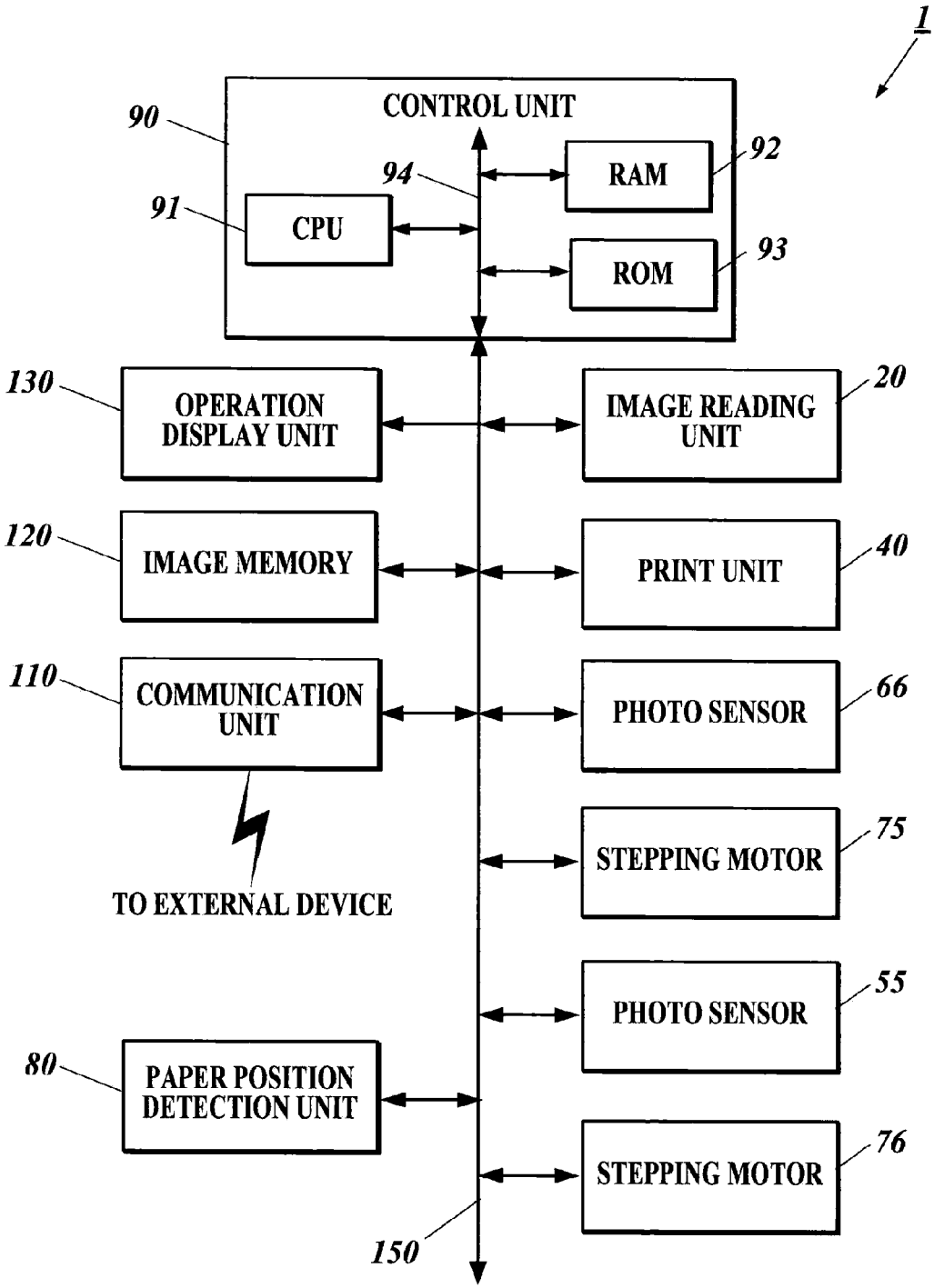
[FIG. 2] This is a functional block diagram of the image forming apparatus.

In FIG. 2, a functional block diagram of the image forming device 1 is shown. The image forming apparatus 1 comprises a control unit 90, a communication unit 110, an image memory 120, an operation display unit 130, photo sensors 55 and 66 and stepping motors 75 and 76.

The control unit 90 comprises a CPU 91, a RAM 92, a ROM 93 and the like, and they are connected to each other with a bus 94. The control unit 90 carries out operation control of the image forming apparatus 1 by so-called software process where the software according to the process content is called up from the ROM 93 and the like, and the software is loaded in the RAM 92 to execute the software.

The control unit 90 is connected to the image reading unit 20, the print unit 40, the paper position detection unit 80, the communication unit 110, the image memory 120, the operation display unit 130, the photo sensors 55 and 66, the stepping motors 75 and 76 and the like via a bus 150. The control unit 90 carries out the operation control of the image forming apparatus 1 by controlling each unit based on input of each unit.

For example, when the detection signal of the paper position detection unit 80 is inputted, the control unit 90 calculates the position of paper P based on input timing of the detection signal and time elapsed since the input timing and the control unit 90 carries out a process according to the position of paper P.

The communication unit 110 comprises an interface or the like (for example, NIC (Network Interface Card) or the like) which is connectable with an external device (for example, PC or the like) and enables communication between the image forming apparatus 1 and the external device. For example, the image data which is transmitted from a PC or the like is received by the image forming apparatus 1 via the communication unit 110 and the received image data is stored in the image memory 120.

The image memory 120 is a storage region to store image data to be formed on paper P in the image forming apparatus 1 and is structured with a storage device (for example, volatile memory and the like). The image data read from the image reading unit and the image data transmitted via the communication unit 110 are stored in the image memory 120. The control unit 90 forms an image on paper P based on the image data stored in the image memory 120.

The operation display unit 130 includes a LCD (Liquid Crystal Display), a touch panel and the like, and the operation display unit 130 can carry out various types of information display regarding the image forming apparatus 1, various types of input operations by an operator and the like.

The photo sensors 55 and 56 and the stepping motors 75 and 76 are structures relating to the control of the widthwise position of the secondary transfer belt 51 and the fixing belt 62. Hereinafter, the structure of the secondary transfer belt 51 and the fixing belt 62 and the control the widthwise position of the secondary transfer belt 51 and the fixing belt 62 will be described in detail.

Figure 3:
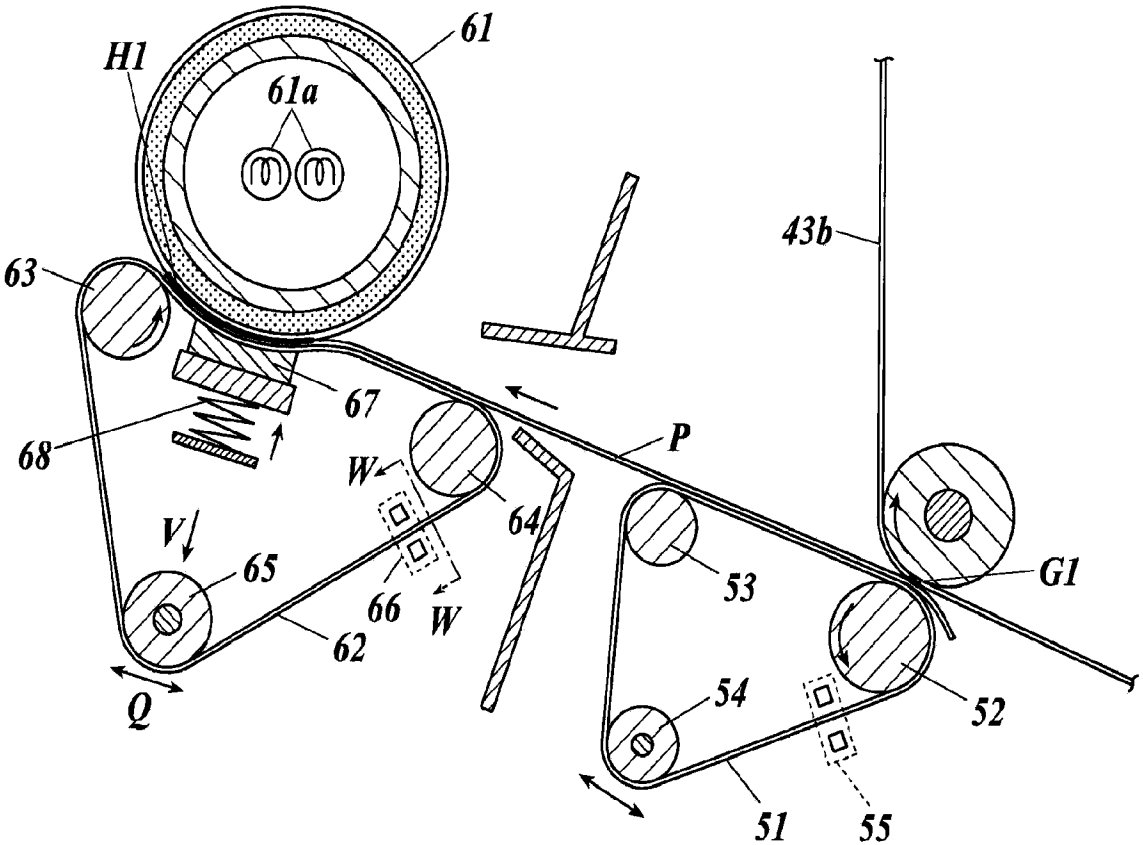
[FIG. 3] This is a detailed cross sectional diagram of a secondary transfer unit and a fixing unit.

In FIG. 3, details of the secondary transfer unit and the fixing unit 60 are shown.

The secondary transfer belt 51 is a belt member in a ring shape, and the secondary transfer roller 52, the driven roller 53 and the steering roller 54 are disposed within the ring of the secondary transfer belt 51. In cooperation of the secondary transfer roller 52, the driven roller 53 and the steering roller 54, the secondary transfer belt 51 is extended therebetween. The secondary transfer roller 52 rotates by the drive of a driving unit (omitted from drawing) such as a motor or the like and drives the secondary transfer belt 51. In the secondary transfer unit, the transfer nip G1 in which the paper P is sandwiched by the secondary transfer belt 51 and the intermediate transfer belt 43*b* is formed and the secondary-transfer is carried out by the secondary transfer roller 52 at the position of the transfer nip G1.

The photo sensor 55 is provided between the secondary transfer roller 52 and the steering roller 54.

The fixing belt 62 is a belt member in a ring shape, and the fixing belt driving roller 63, the driven roller 64 and the steering roller 65 by which the fixing belt 62 is extended therebetween are disposed within the ring of the fixing belt 62. In cooperation of the fixing belt driving roller 63, the driven roller 64 and the steering roller 65, the fixing belt 62 is extended therebetween. The fixing belt driving roller 63 rotates by the drive of a driving unit (omitted from drawing) such as a motor or the like and drives the fixing belt 62.

The photo sensor 66 is provided between the driven roller 64 and the steering roller 65.

A pressure-contacting member 67 is provided at a position so as to face the rotary fixing member 61 across the fixing belt 62. The pressure-contacting member 67 is impelled to the rotary fixing member 61 side by the elasticity of a spring 68. In such way, the rotary fixing member 61 and the fixing belt 62 form the fixing nip H1 to sandwich paper P by cooperation with each other.

With respect to the direction along the conveyance direction of paper P, the width between the transfer nip G1 and the fixing nip H1 is smaller than the maximum length of the paper P which can be used in the image forming apparatus 1 along the conveyance direction of the paper P. That is, according to the maximum length of the paper P along the conveyance direction of the paper P, there is a possibility that the paper P will be nipped at both of the transfer nip G1 and the fixing nip H1.

Next, a structure for controlling the widthwise position of the secondary transfer belt 51 and the fixing belt 62 will be described based on the structure relating to the control of position of the fixing belt 62.

Figure 4:
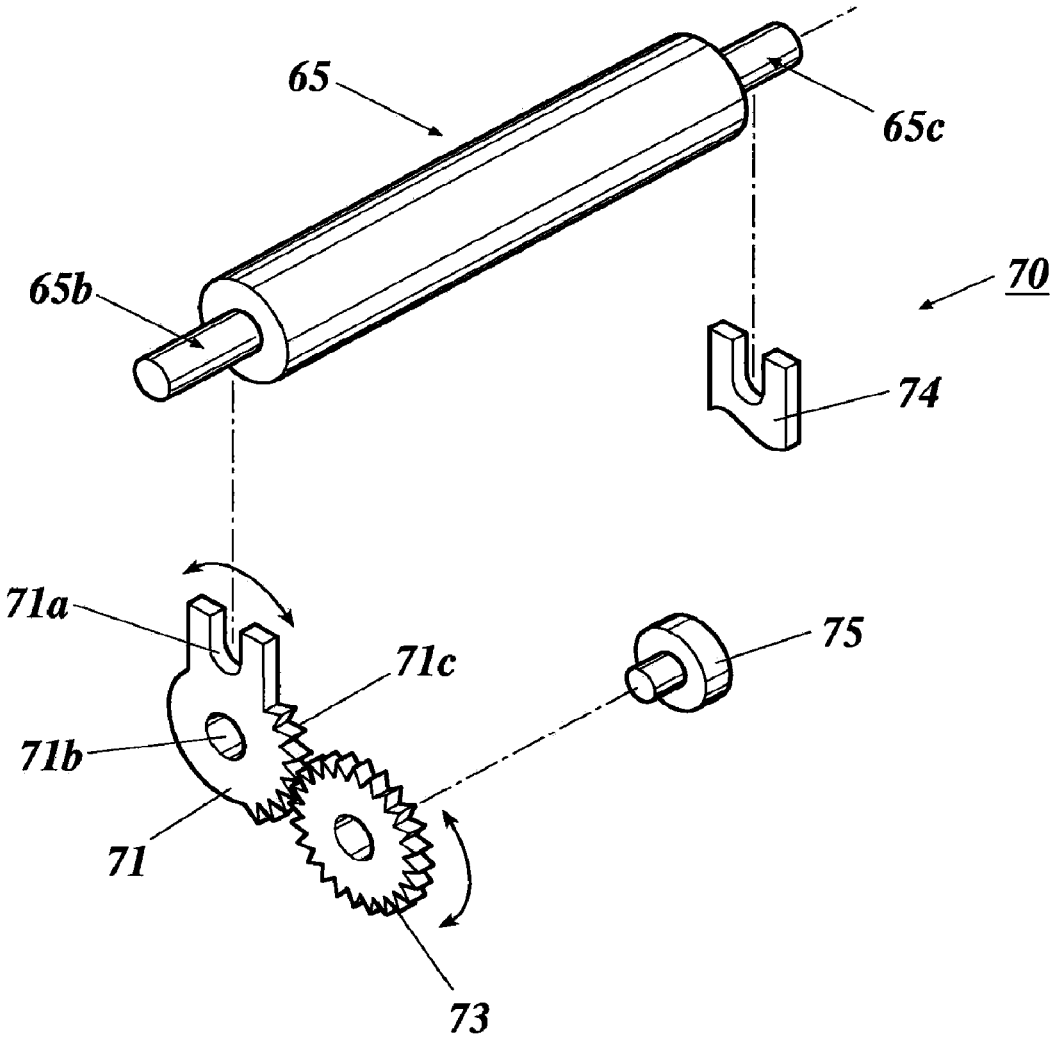
[FIG. 4] This is a schematic structural diagram of a steering roller angle changing unit.

In FIG. 4, a schematic diagram of a steering roller angle changing unit 70 is shown. The steering roller 65 is provided so that the contacting angle of the steering roller 65 with respect to the operation direction of the fixing belt 62 can be changed by the steering roller angle changing unit 70. The steering roller angle changing unit 70 comprises a rotation member 71, a rotation gear 73, a supporting unit 74 and a stepping motor 75.

In the steering roller 65, one end 65*b* of the axis of the steering roller 65 is supported by a U-shaped groove 71*a*. The rotation member 71 is supported so as to rotate centering around the axis 71*b* in a direction along the width direction of the fixing belt. The rotation member 71 includes a gear unit 71*c* which mesh with the rotation gear 73.

The rotation gear 73 is connected with the stepping motor 75 and the rotation angle thereof changes by the driving of the stepping motor 75. The rotation member 71 rotates in a rotation angle according to the rotation angle of the rotation gear 73 and is supported, and in such way, the rotation member 71 rotates and supports the one end 65*b* of the steering roller 65.

The other end 65*c* of the axis of the steering roller 65 is supported by a supporting unit 74 which is provided at the frame in the image forming apparatus 1. The supporting unit 74 rotatably supports the steering roller 65 and supports the steering roller 65 in a state where one end side of the steering roller 65 can be rotated by the rotation member 71. In such way, the one end 65*b* side of the steering roller 65 is provided so as to rotate as in the arrow Q shown in FIG. 2, and the contacting angle with respect to the operation direction of the fixing belt 62 can be changed.

Figure 5:
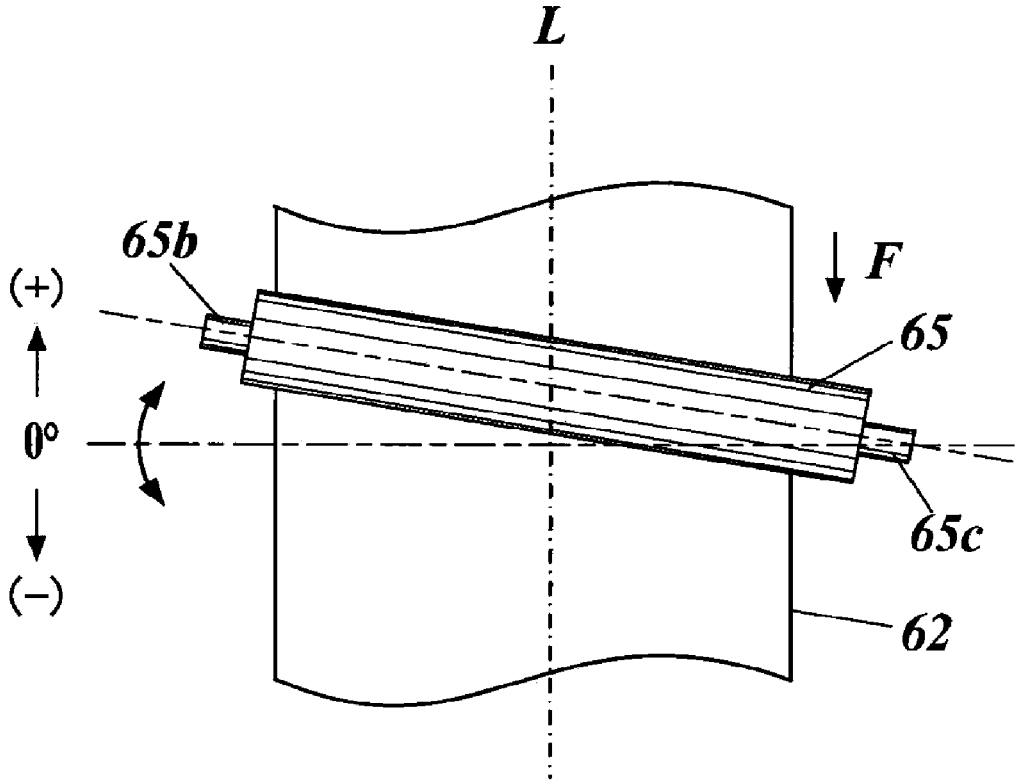
[FIG. 5] This is an explanatory diagram showing relation between axis angel of a steering roller and a fixing belt when seen in a direction of V of FIG. 3.

In FIG. 5, an explanatory diagram of relation between axis angle of the steering roller 65 and the fixing belt 62 when seen from the V direction in FIG. 3 is shown. In FIG. 5, the position which is preferable for the center line of the widthwise of the fixing belt 62 to be placed is shown in a dashed line L. The dashed line L is the widthwise position of the fixing belt 62 where the rotary fixing member 61 and the fixing belt 62 can be most favorably pressure contacted, for example.

When the one end 65*b* of the steering roller 65 rotates in the operation direction F side (−(minus) direction in FIG. 5) of the fixing belt 62 than the other end 65*c*, the fixing belt 62 is guided to the other end 65*c* side of the steering roller 65. On the other hand, when the one end 65*b* of the steering roller 65 rotates in the opposite side (+(plus) direction in FIG. 5) of the operation direction F of the fixing belt 62 with respect to the other end 65*c*, the fixing belt 62 is guided to the one end 65*b* side of the steering roller 65. Therefore, by controlling the rotation angle of the steering roller, the widthwise position of the fixing belt 62 is corrected so that the center line of the fixing belt 62 overlaps the dashed line L.

Figure 6:
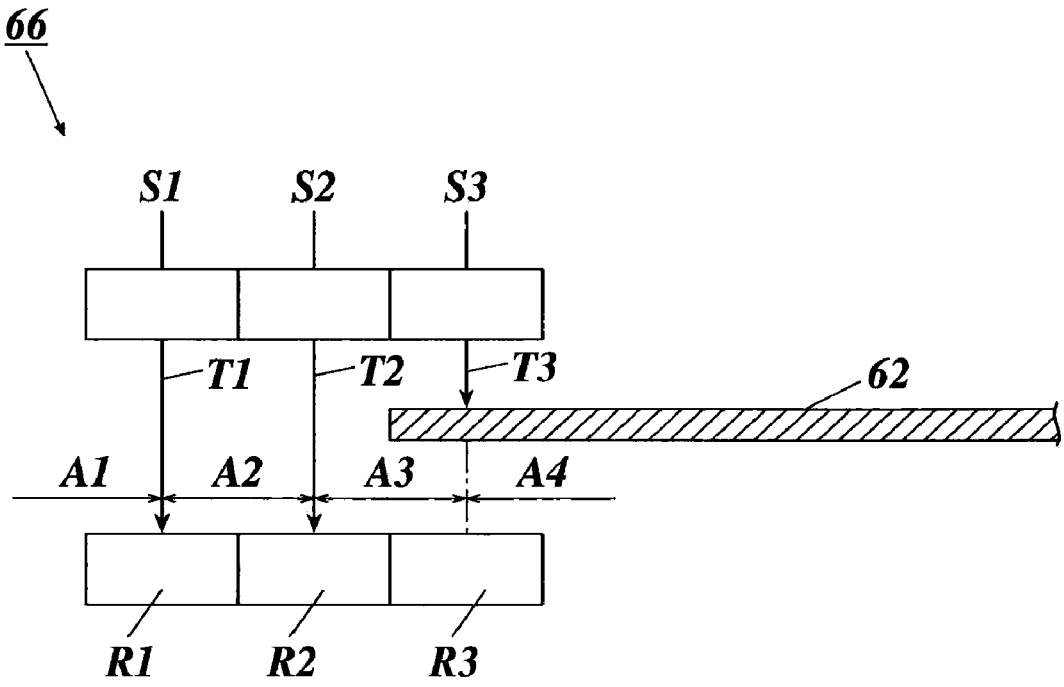
[FIG. 6] This is a W-W cross sectional diagram of FIG. 3 showing positional relation between a photo sensor and the fixing belt.

In FIG. 6, positional relation between the photo sensor 66 and the fixing belt 62 is shown. FIG. 6 is the W-W cross sectional diagram of FIG. 3.

As shown in FIG. 6, the photo sensor 66 includes light emitting elements S1 to S3 and light receiving elements R1 to R3. The light emitting elements S1 to S3 and the light receiving elements R1 to R3 are respectively provided at positions facing each other across the fixing belt 62. The light emitting elements S1 to S3 irradiate light (for example, infrared light or the like) to the light receiving elements R1 to R3, respectively. Each of the light receiving elements R1 to R3 outputs a signal indicating exist/non-exist detection of the light (hereinafter, called irradiated light) which is irradiated from the light emitting elements S1 to S3. The signals are inputted to the control unit 90.

When the fixing belt 62 is positioned between any one of or a plurality of the pair of light emitting elements S1 to S3 and the light receiving elements R1 to R3, any one of or a plurality of the irradiation lights T1 to T3 which is the irradiation lights from the light emitting elements S1 to S3 to the light receiving elements R1 to R3 is blocked by the fixing belt 62, and the irradiation light is not detected by any one of or a plurality of the light receiving elements R1 to R3. Therefore, the detection pattern of irradiation light by the light receiving elements R1 to R3 of the photo sensor 66 changes according to the widthwise position of the fixing belt 62.

In the following description, with respect to the position of the end of the widthwise of the fixing belt 62 in the side where photo sensor 66 is provided, the area outside than the irradiation line T1 with respect to the fixing belt 62 is set as a region A1, the area between the irradiation line T1 and the irradiation line T2 is set as a region A2, the area between the irradiation line T2 and the irradiation line T3 is set as a region A3 and the area outside than the irradiation line T3 is set as a region A4.

In FIG. 7, correspondence relation between the exist/non-exist pattern of light detection of the light receiving elements R1 to R3 of the photo sensor 66 and the widthwise position of the fixing belt 62 shown in FIG. 6 is shown in a table format. In FIG. 7 and in the following description, a case where each of the light receiving elements R1 to R3 detect the irradiation light is indicated as ON and a case where each of the light receiving elements R1 to R3 does not detect the irradiation light is indicated as OFF.

As shown in FIG. 7, regarding the widthwise position of the fixing belt 62, the fixing belt 62 is positioned in the region A4 of FIG. 4 when all of the light receiving elements R1 to R3 are ON. Similarly, when the light receiving elements R1 and R2 are ON and when the light receiving element R3 is OFF, the fixing belt 62 is positioned in the region A3 of FIG. 4. When the light receiving element R1 is ON and when the light receiving elements R2 and R3 are OFF, the fixing belt 62 is positioned in the region A2 of FIG. 4. When all of the light receiving elements R1 to R3 are OFF, the fixing belt 62 is positioned in the region A1 of FIG. 4.

Operation control of the photo sensor 66 is carried out by the control unit 90. The control unit 90 carries out a measuring of the widthwise position of the fixing belt 62 by operating the photo sensor 66.

The control unit 90 recognizes the widthwise position of the fixing belt 62 based on the signal of the photo sensor 66. The control unit 90 controls the rotation angle of the steering roller 65 based on the widthwise position of the fixing belt 62. At this time, the control unit 90 determines whether the paper P is positioned at either one or at both of the transfer nip G1 and the fixing nip H1 based on the detection signal of the paper position detection unit 80 and calls up a steering control amount table according to the determination result. Hereinafter, the steering control amount table will be described with reference to FIGS. 8A and 8B.

The steering control amount table of the first embodiment is shown in FIG. 8A.

The steering control amount table is a table showing correspondence relation between the widthwise position of the fixing belt 62 and change in rotation angle of the steering roller 65 by the control unit 90. The steering control amount table is stored in the ROM 93, and is called up and read by the CPU 91 in time of rotation angle control of the steering roller 65 by the control unit 90. In the steering control amount table of FIG. 8A and in the following description, a condition where the paper P is nipped by both of the transfer nip G1 and the fixing nip H1 at the same time is called "with paper restraint" and the alternative condition, that is, where the paper P is not nipped by either one of the transfer nip G1 and the fixing nip H1 or where the paper P is nipped by either one of the transfer nip G1 or the fixing nip H1 is called "without paper restraint".

In FIG. 8B, correspondence relation between change in rotation angle of the steering roller in the steering control amount table of the first embodiment and axis angle of the steering roller 65 is shown in a table format. The axis angles in FIG. 8B show the rotation angle of rotation axis of the steering roller 65. With regards to the rotation angle, in the positional relation between the fixing belt 62 and the steering roller 65 shown in FIG. 5, the angle orthogonal to the operation direction F of the fixing belt 62 is indicated as 0 [degrees], the rotation angle of minus direction is indicated as −(minus) angle and the rotation angle of plus direction is indicated as +(plus) angle. In the following description of the fixing belt 62, a case where the rotation angle of the steering roller 65 is not to be changed is indicated as 0, a case where the rotation angle is controlled so as to be changed by 1 [degrees] is indicated as 2 levels and a case where the rotation angle is controlled so as to be changed by 2 [degrees] is indicated as 4 levels, as shown in FIG. 8B.

The control unit 90 controls the change in rotation angle of the steering roller 65 based on the widthwise position of the fixing belt 62, whether the paper is nipped by the transfer nip G1 and the fixing nip H1 or not and the steering control amount table.

When there is no paper restraint, regarding the rotation angle of the steering roller 65, the control unit 90 carries out the rotation angle control of −4 levels, −2 levels, +2 levels and +4 levels to the fixing belt 62 which is in the regions A1 to A4, respectively.

On the other hand, when there is paper restraint, the control unit 90 sets the change in rotation angle of the steering roller 65 to 0 regardless of the position of the fixing belt 62. That is, the control unit 90 does not carry out change in rotation angle of the steering roller when there is paper restraint.

As described above, change in rotation angle of the steering roller 65 is carried out when there is no paper restraint. In such way, correction of the widthwise position of the fixing belt 62 is carried out.

On the other hand, when change in rotation angle of the steering roller 65 is carried out when the paper P is nipped by the transfer nip G1 and the fixing nip H1, there is a possibility that distortion and wrinkles occur in the paper P due to receiving the pressure-contacting force to the paper P by the cooperation of the rotary fixing member 61 and the fixing belt 62 and the moving vector of the widthwise of the fixing belt 62 at the same time. Therefore, when there is paper restraint, the control unit 90 does not carry out change in rotation angle of the steering roller 65.

Figure 9:
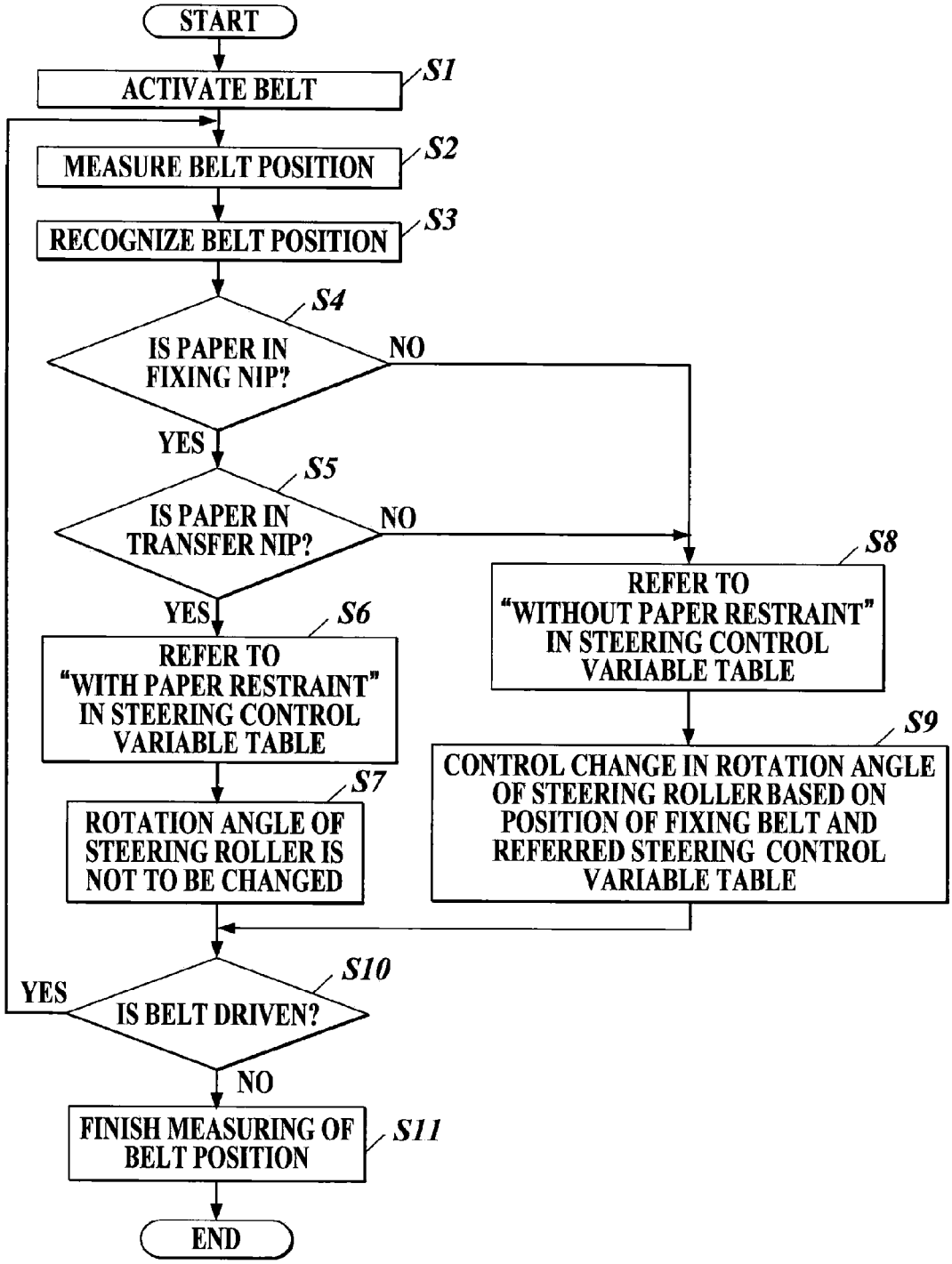
[FIG. 9] This is a flowchart showing a process relating to control of rotation angle of the steering roller in the first embodiment.

Next, the operation control of the image forming apparatus 1 of the first embodiment, in particular, a process relating to the control of rotation angle of the steering roller 65 will be described by using the flowchart of FIG. 9.

When forming of an image to paper P by the image forming apparatus 1 is started, the control unit 90 activates the fixing belt 62 (step S1).

The control unit 90 carries out measuring of belt position by operating the photo sensor 66 (step S2). The light receiving elements R1 to R3 of the photo sensor 66 output signals indicating exist/non-exist of detection of light. The control unit 90 recognizes the widthwise position of the fixing belt 62 based on the signals inputted from the photo sensor 66 (step S3).

The control unit 90 determines whether the paper P is in the fixing nip H1 or not and determines whether the paper P is in the transfer nip G1 or not based on whether there is the detected signal of the paper position detection unit 80 or not (steps S4 and 5). When the paper P is in the fixing nip H1 (step S4: YES) and in the transfer nip G1 (step S5: YES) at the same timing, that is, when the paper P is nipped by both of the transfer nip G1 and the fixing nip H1 at the same time, the control unit 90 refers to "with paper restraint" in the steering control amount table (step S6).

The control unit 90 controls the stepping motor 75 so as to change the rotation angle of the steering roller 65 based on the widthwise position of the fixing belt 62 which is recognized in step S3 and the change in rotation angle of the steering roller 65 which is referred to in step S6. However, the change in rotation angle of the steering roller 65 in "with paper restraint" which is referred to in step S6 is 0 regardless of the widthwise position of the fixing belt 62. Therefore, the control unit 90 does not carry out change in the rotation angle of the steering roller (step S7).

When the paper P is in the fixing nip H1 (step S4: YES) and not in the transfer nip G1 (step S5: NO) or when the paper P is not in the fixing nip H1 (step S4: NO), the control unit 90 refers to "without paper restraint" in the steering control amount table (step S8).

The control unit 90 controls the stepping motor 75 so as to change the rotation angle of the steering roller 65 based on the widthwise position of the fixing belt 62 which is recognized in step S3 and the change in rotation angle of the steering roller 65 by the control unit 90 which is referred to in step S8 (step S9).

After the process of step S7 or step S9, when the fixing belt 62 continues to operate (step S10: YES), the control unit 90 repeats the processes of steps S2 to S10. When the fixing belt 62 stops (step S10: NO), the measuring of belt position by the photo sensor 66 is finished (step S11), and the process ends.

FIGS. 4 to 9 and the structure relating to the control of change in rotation angle of the steering roller 65 of the first embodiment and the structure relating to the detection of the widthwise position of the fixing belt 62 by the photo sensor 66 of the first embodiment as described above are similarly applied to the relation between the steering roller 54, the photo sensor 55 and the secondary transfer belt 51. The steering roller 54 changes its rotation angle by the driving of the stepping motor 76.

In the first embodiment, when there is paper restraint, it is structured so that the change in rotation angle of the steering roller 65 is not carried out by reading the steering control amount table where the change is 0 in all positions of the widthwise of the fixing belt 62 and so that correction of the widthwise position of the fixing belt 62 is not carried out. However, when there is paper restraint, other process for not changing the rotation angle of the steering roller 65 and for not carrying out the correction of the widthwise position of the fixing belt 62 may be applied. For example, when there is paper restraint, it may be controlled so as not to change the rotation angle of the steering roller 65 by not reading the steering control amount table. This similarly applies to the correction of the widthwise position of the secondary transfer belt 51 by controlling the rotation angle of the steering roller 54.

According to the first embodiment, when there is paper restraint, the control unit 90 does not carry out change in rotation angle of the steering roller 65. Therefore, distortion, wrinkles and the like of the paper P which occurs when moving of the widthwise of the fixing belt 62 is carried out in a state where the paper is restrained do not occur. Additionally, when there is paper restraint, that is, only when the paper is nipped by both of the transfer nip G1 and the fixing nip H1, the control unit 90 controls the stepping motor 75 so as not to carry out change in the rotation angle of the steering roller 65. Therefore, even when the paper is nipped by either one of the transfer nip G1 or the fixing nip H1, the control unit 90 controls so as to carry out the correction of the widthwise of the fixing belt 62 and to continue the image forming process to the paper P. In such way, the time in which positional correction of the widthwise of the fixing belt 62 is not carried out can be minimized and the positional correction can be sufficiently carried out at the timing when there is no paper restraint. Therefore, the image forming will not be halted for carrying out the positional correction. Thus, the image forming apparatus in which distortion of paper does not occur and which has high productivity can be provided.

Moreover, the fixing belt 62 is extended by the steering roller 65 and the change in the widthwise position of the fixing belt 65 is carried out by changing the rotation angle of the steering roller 65 by the steering roller angle changing unit 70. The steering roller 65 can arbitrarily guide the fixing belt 62 with regards to the widthwise of the fixing belt 62 according to the rotation angle. Therefore, control of the belt position can be carried out surely according to the rotation angle of the steering roller 65.

Furthermore, when there is paper restraint, the control unit 90 does not carry out change in rotation angle of the steering roller 54. Therefore, distortion, wrinkles and the like of the paper P which occur when moving of the widthwise of the secondary transfer belt 51 is carried out in a state where there is paper restraint do not occur. Additionally, when there is paper restraint, that is, only when the paper is nipped by both of the transfer nip G1 and the fixing nip H1, the control unit 90 controls the stepping motor 76 so as not to carry out change in the rotation angle of the steering roller 54. Therefore, even when the paper is nipped by either one of the transfer nip G1 or the fixing nip H1, the control unit 90 controls so as to carry out correction of the widthwise of the secondary transfer belt 51 and also to continue the image forming process to the paper P. In such way, the time in which positional correction of the widthwise of the secondary transfer belt 51 is not carried out can be minimized and the positional correction can be sufficiently carried out at the timing when there is no paper restraint. Therefore, the image forming does not need to be halted to carry out the positional correction. Thus, the image forming apparatus in which distortion of paper does not occur and which has high productivity can be provided.

Moreover, the transfer belt 51 is extended by the steering roller 54, and change in the widthwise position of the transfer belt 51 is carried out by changing the rotation angle of the steering roller 54 by the steering roller angle changing unit 70. The steering roller 54 can arbitrarily guide the transfer belt 51 with regards to the widthwise of the transfer belt 51 according to the rotation angle. Therefore, the control of belt position can be carried out surely according to the rotation angle of the steering roller 54.

(Second Embodiment)

Next, the second embodiment which is an embodiment of the present invention different from the first embodiment will be described. In the description of the second embodiment, same symbols are used for structures which are similar to the structures of the first embodiment and the descriptions are omitted.

The image forming apparatus according to the second embodiment has a structure similar to the structure of the first embodiment except for the steering control amount table shown in FIG. 10A, the correspondence relation between the steering roller control amount in the steering control amount table and axis angle of the steering roller shown in FIG. 10B and the process relating to the control of rotation angle of the steering roller.

In FIG. 10A, the steering control amount table is shown.

The steering control amount table is a table showing the correspondence relation between the widthwise position of the fixing belt 62 and change in rotation angle of the steering roller 65 by the control unit 90. The steering control amount table is stored in the ROM 93 and is called up and read by the CPU 91 in time of control of rotation angle of the steering roller 65 by the control unit 90. In the steering control amount table of FIG. 10A and in the following description, a condition where the paper P is not nipped by either of the transfer nip G1 and the fixing nip H1 is indicated as "without paper restraint", a condition where the paper P is nipped by either one of the transfer nip G1 or the fixing nip H1 is indicated as "with paper restraint in either one of nips" and a condition where the paper P is nipped by both of the transfer nip G1 and the fixing nip H1 is indicated as "with paper restraint in both nips".

In FIG. 10B, the correspondence relation between change in rotation angle of the steering roller in the steering control amount table and axis angle of the steering roller 65 is shown in a table format. The axis angles in FIG. 10B indicate rotation angle of the rotation axis of the steering roller 65. With regards to the rotation angle, in the positional relation of the fixing belt 62 and the steering roller 65 shown in FIG. 5, the angle orthogonal to the operation direction F of the fixing belt 62 is indicated as 0 [degrees], the rotation angle of minus direction is indicated as −(minus) angle and the rotation angle of plus direction is indicated as +(plus) angle. In the following description of the fixing belt 62, when the rotation angle of the steering roller 65 is not changed is indicated as 0, the control in which the rotation angle is changed for 0.5 [degrees] is indicated as 1 level, the control in which the operation angle is changed for 1 [degree] is indicated as 2 levels and the control in which the operation angle is changed for 2 [degrees] is indicated as 4 levels.

The control unit 90 controls the change in rotation angle of the steering roller 65 based on the widthwise position of the fixing belt 62, whether the paper is nipped by the transfer nip G1 and the fixing nip H1 or not and the steering control amount table.

Regarding the rotation angle of the steering roller 65, when there is no paper restraint, the control unit 90 carries out the control of rotation angle of −4 levels, −2 levels, +2 levels and +4 levels to the fixing belt 62 in the positions of regions A1 to A4, respectively.

On the other hand, regarding the rotation angle of the steering roller 65, when there is paper restraint in either one of the nips, the control unit 90 respectively carries out the control of rotation angle of −2 levels, −1 level, +1 level and +2 levels to the fixing belt 62 in the positions of regions A1 to A4. Regarding the rotation angle of the steering roller 65, when there is paper restraint at both of the nips, the control unit 90 respectively carries out the control of rotation angle of −1 level, 0, 0, +1 level to the fixing belt 62 in the positions of regions A1 to A4.

As described above, the change in rotation angle of the steering roller 65 is the largest when there is no paper restraint. Therefore, guiding of the position of the widthwise of the fixing belt 62 which is carried out by the control of rotation angle of the steering roller 65 in plus or minus becomes most prominent when there is no paper restraint, and the correction of the widthwise position of the fixing belt 62 is carried out promptly.

On the other hand, when the change in rotation angle of the steering roller 65 is made to be large when the paper is nipped by the fixing nip H1, there is a possibility that distortion and wrinkles occur in the paper P due to receiving the pressure-contacting force to the paper P by the cooperation of the rotary fixing member 61 and the fixing belt 62 and the moving vector of the widthwise of the fixing belt 62 at the same time. In particular, when there is paper restraint at both of the nips, the distortion and wrinkles easily occur due to both of the upstream end and the downstream end in the conveyance direction of the paper P are being nipped. Therefore, when there is paper restraint at either one of the nips or at both of the nips, the control unit 90 makes the change in rotation angle of the steering roller 65 be relatively small comparing to the case where there is no paper restraint.

In particular, when there is paper restraint at both of the nips, distortion and wrinkles in the paper P upon moving of the widthwise of the fixing belt 62 easily occur in a greater extent. Therefore, the change in rotation angle of the steering roller 65 is made to be smaller comparing to the case where there is paper restraint in either one of the nips.

Figure 11:
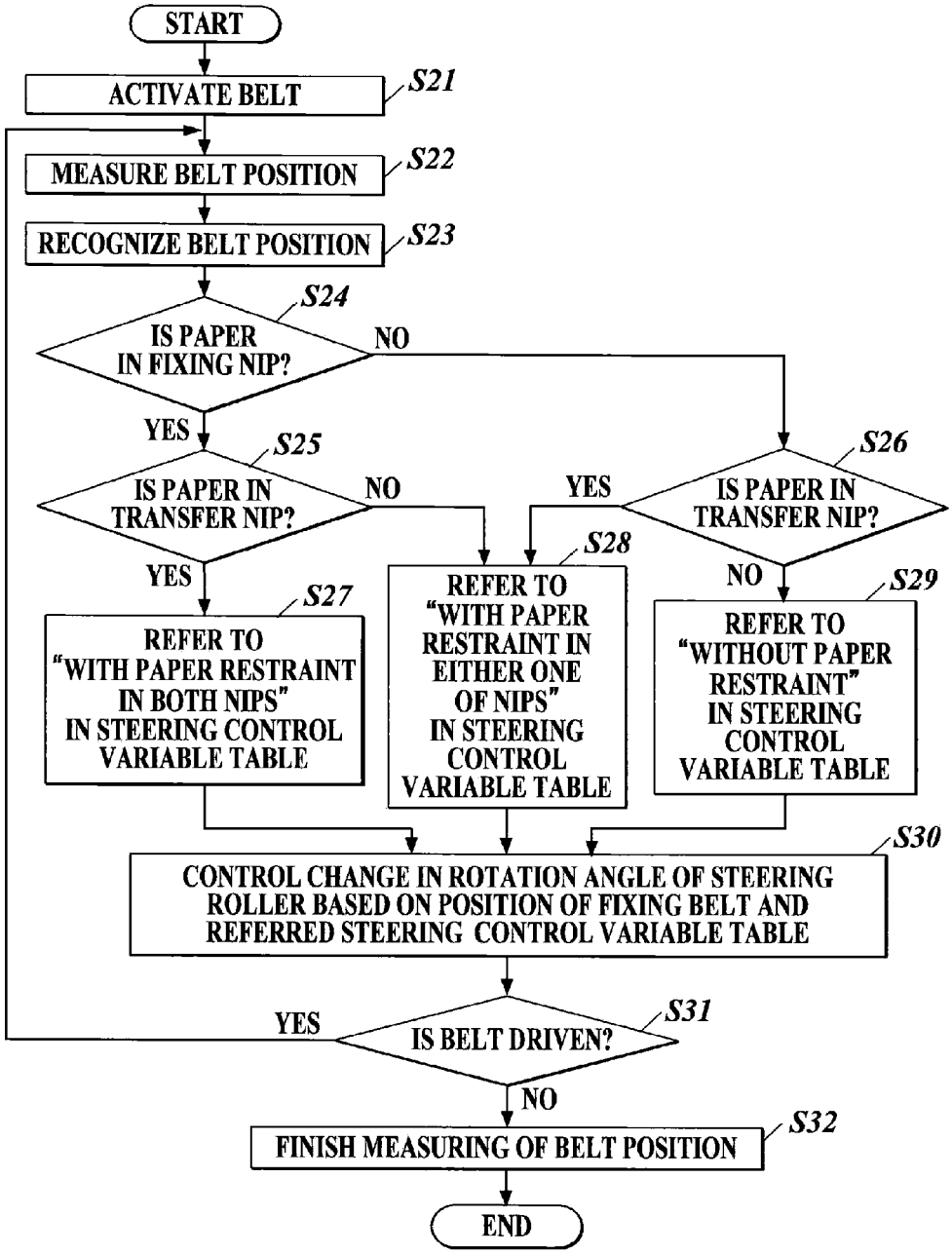
[FIG. 11] This is a flowchart showing a process relating to control of rotation angle of the steering roller in the second embodiment.

Next, the operation control of the image forming apparatus 1, in particular, a process relating to the control of rotation angle of the steering roller 65 will be described by using the flowchart of FIG. 11.

When the image forming to the paper P by the image forming apparatus 1 is started, the control unit 90 activates the fixing belt 62 (step S21).

The control unit 90 carries out measuring of belt position by operating the photo sensor 66 (step S22). The light receiving elements R1 to R3 of the photo sensor 66 output signals indicating exist/non-exist of light detection. The control unit 90 recognizes the widthwise position of the fixing belt 62 based on the signals inputted from the photo sensor 66 (step S23).

The control unit 90 determines whether the paper P is in the fixing nip H1 or not and determines whether the paper P is in the transfer nip G1 or not based on whether there is a detection signal of the paper position detection unit 80 (steps S24 to S26). When the paper P is in the fixing nip H1 (step S24: YES) and the paper P is in the transfer nip G1 (step S25: YES) at the same timing, that is, when the paper P is nipped by both of the transfer nip G1 and the fixing nip H1 at the same time, the control unit 90 refers to "with paper restraint in both nips" in the steering control amount table (step S27). When the paper P is in the fixing nip H1 (step S24: YES) and not in the transfer nip G1 (step S25: NO) or when the paper P is not in the fixing nip H1 (step S24: NO) and in the transfer nip G1 (step S26: YES), the control unit 90 refers to "with paper restraint in either one of nips" in the steering control amount table (step S28). When the paper P is not in the fixing nip H1 (step S24: NO) and not in the transfer nip G1 (step S26: NO), the control unit 90 refers to "without paper restraint" in the steering control amount table (step S29).

the control unit 90 controls the stepping motor 75 so as to change the rotation angle of the steering roller 65 based on the widthwise position of the fixing belt 62 which is recognized in step S3 and the change in rotation angle of the steering roller 65 by the control unit 90 which is referred to in either one of steps S27 to S29 (step S30).

When the fixing belt 62 continues to operate (step S21: YES), the control unit 90 repeats the processes of steps S22 to S30. When the fixing belt 62 stops (step S31: NO), the measuring of belt position by the photo sensor 66 is finished (step S32), and the process ends.

FIGS. 4 to 7, FIG. 10 and FIG. 11 and the structure relating to the control of change in rotation angle of the steering roller 65 of the second embodiment and the structure relating to the detection of the widthwise position of the fixing belt 62 by the photo sensor 66 of the second embodiment as described above are similarly applied to the relation between the steering roller 54, the photo sensor 55 and the secondary transfer belt 51. The steering roller 54 changes its rotation angle according to the driving of the stepping motor 76.

According to the second embodiment, the control unit 90 makes the change in the widthwise position of the fixing belt 62 be different between when there is paper restraint at both of the nips and when this is not the case. In such way, the control of change in the widthwise position of the fixing belt 62 can be carried out based on the optimal change in position in each of the cases when there is paper restraint in both of the nips and when this is not the case. For example, regarding each of the changes in position of the fixing belt 62 in each of the cases when there is paper restraint at both of the nips and when this is not the case, by setting the change in position so as to be a change where distortion does not occur in the paper, the image forming apparatus which can carry out the image forming in good condition without occurrence of distortion in the paper and without occurrence of reduction in productivity such as temporary halting of the image forming process due to the controlling of position of the fixing belt 62 can be provided.

Further, when there is paper restraint at both of the nips, the control unit 90 makes the change in the widthwise position of the fixing belt 62 be small by controlling the stepping motor 75 so as to make the change in rotation angle of the steering roller 65 be smaller comparing to when the above is not the case. Therefore, the distortion, wrinkles and the like of the paper P which occur when a major correction is carried out to the widthwise of the fixing belt 62 in a state where there is paper restraint in both of the nips do not occur. Additionally, when there is paper restraint in both of the nips, the control unit 90 continues the image forming process to the paper P without stopping the process while carrying out the correction of widthwise of the fixing belt 62 by making the change in rotation angle of the steering roller 65 be small. Therefore, the image forming apparatus in which image forming of good condition can be carried out without occurrence of distortion of paper and without occurrence of reduction in productivity can be provided.

Moreover, the control unit 90 makes the change in widthwise position of the fixing belt 62 be different between when there is paper restraint in either one of the nips and when there is no paper restraint. In such way, controlling of change in widthwise position of the fixing belt 62 based on the optimum amount of position change can be carried out for each of the cases where there is paper restraint in either one of the nips and where there is no paper restraint. For example, regarding the amount of position change of the fixing belt 62 for each of the cases where there is paper restraint in either one of the nips and where there is no paper restraint, by setting the amount of position change to the amount where distortion does not occur in the paper, the image forming apparatus which can carry out the image forming in good condition without occurrence of distortion in the paper and without occurrence of reduction in productivity such as temporary halting of the image forming process due to the controlling of position of the fixing belt 62 can be provided.

Moreover, when there is paper restraint in either one of the nips, the control unit 90 makes the amount of position change of the widthwise of the fixing belt 62 be small by controlling the stepping motor 75 so as to make the change in rotation angle of the steering roller 65 be smaller than when there is no paper restraint. When there is paper restraint in either one of the nips, distortion, wrinkles and like of the paper due to the widthwise of the paper P which is nipped at two places being pulled in different directions as in the case where there is paper restraint in both of the nips do not occur. However, when the fixing belt 62 which nips the paper P with the rotary fixing member 61 is drastically corrected regarding its widthwise direction, there is a possibility that poor fixing, distortion of paper and the like occur due to occurrence of rippling in the fixing belt 62 or the like. Therefore, when there is paper restraint in either one of the nips, the poor fixing, distortion of paper and the like are prevented in good condition by making the change in rotation angle of the steering roller 65 be smaller than that of when there is no paper restraint.

Further, the steering roller 65 is controlled so as to make the change in rotation angle be small when the paper P positions at the transfer nip G1. Thereafter, the steering roller 65 is controlled so as to make the change in rotation angle be even smaller when the paper P is nipped by both of the transfer nip G1 and the fixing nip H1. In such way, the change in rotation angle of the steering roller 65 is control so as to be smaller gradually. In this way, occurrence of distortion, wrinkles, ripping and the like of the paper P due to the conveyance direction of the paper P being suddenly changed when the rotation angle is controlled so as to be small abruptly when the paper P is nipped by the fixing nip H1 can be prevented in good condition.

Furthermore, the fixing belt 62 is extended by the steering roller 65 and the change in widthwise position of the fixing belt 65 is carried out by changing the rotation angle of the steering roller 65 by the steering roller angle changing unit 70. The steering roller 65 can arbitrarily guide the fixing belt 62 regarding the widthwise direction of the fixing belt 62 by the rotation angle. Therefore, the control of belt position can be carried out surely according to the rotation angle of the steering roller 65.

Moreover, the control unit 90 makes the amount of change in the widthwise position of the secondary transfer belt 51 be different between when there is paper restraint in both nips and when this is not the case. The control unit 90 makes the amount of change in the widthwise position of the fixing belt 62 be different between when there is paper restraint in both of the nips and when this is not the case. In this way, the control of change in the widthwise position of the fixing belt 62 based on an optimum amount of position change can be carried out for each of the cases where there is paper restraint in both of the nips and where this is not the case. For example, regarding the amount of position change of the secondary transfer belt 51 for each of the cases where there is paper restraint in both of the nips and where this is not the case, by setting the amount of position change to the amount where distortion does not occur in the paper, the image forming apparatus which can carry out the image forming in good condition without occurrence of distortion in the paper and without occurrence of reduction in productivity such as temporary halting of the image forming process due to the controlling of position of the secondary transfer belt 51 can be provided.

Further, when there is paper restraint in both of the nips, the control unit 90 makes the amount of change in the widthwise position of the secondary transfer belt 51 be small by controlling the stepping motor 76 so as to make the change in rotation angle of the steering roller 54 be smaller than that of when the above is not the case. Therefore, the distortion, wrinkles and the like of the paper P which occur when a major correction is carried out to the widthwise of the secondary transfer belt 51 in a state where there is paper restraint in both of the nips do not occur. Additionally, by making the change in rotation angle of the steering roller 54 be small when there is paper restraint in both of the nips, the control unit 90 continues the image forming process to the paper P without stopping the process while carrying out the correction of the widthwise of the secondary transfer belt 51. Therefore, the image forming apparatus which can carry out the image forming in good condition without occurrence of distortion of paper and without occurrence of reduction in productivity can be provided.

Furthermore, the control unit 90 makes the amount of change in the widthwise position of the secondary transfer belt 51 be different between when there is paper restraint in either one of the nips and when there is no paper restraint. In such way, the control of change in the widthwise position of the secondary transfer belt 51 based on an optimum amount of position change can be carried out for each of the cases where there is paper restraint in either one of the nips and where there is no paper restraint. For example, regarding the amount of position change of the secondary transfer belt 51 in each of the cases where there is paper restraint in either one of the nips and where there is no paper restraint, by setting the amount of position change to the amount where distortion does not occur in the paper, the image forming apparatus which can carry out the image forming in good condition without occurrence of distortion in the paper and without occurrence of reduction in productivity such as temporary halting of the image forming process due to the controlling of position of the secondary transfer belt 51 can be provided.

Moreover, when there is paper restraint in either one of the nips, the control unit 90 makes the amount of change in the widthwise position of the secondary transfer belt 51 be small by controlling the stepping motor 76 so as to make the change in rotation angle of the steering roller 54 be smaller than that of when there is no paper restraint. When there is paper restraint in either one of the nips, distortion, wrinkles and the like of the paper due to the widthwise of the paper P which is nipped at two parts being pulled in different directions as in the case where there is paper restraint in both of the nips do not occur. However, when the widthwise of the secondary transfer belt 51 which nips the paper P with the intermediate transfer belt 43*b* is drastically corrected, there is a possibility that poor transfer, distortion of paper and the like occur due to the occurrence of rippling in the secondary transfer belt 51 and the like. Therefore, when there is paper restraint in either one of the nips, the poor fixing, distortion of paper and the like can be prevented in good condition by making the change in rotation angle of the steering roller 54 be smaller than that of when there is no paper restraint.

Furthermore, the transfer belt 51 is extended by the steering roller 54 and the change in the widthwise position of the transfer belt 51 is carried out by changing the rotation angle of the steering roller 54 by the steering roller angle changing unit 70. The steering roller 54 can arbitrarily guide the transfer belt 51 regarding the widthwise direction of the transfer belt 51 according to the rotation angle. Therefore, controlling of belt position can be carried out surely according to the rotation angle of the steering roller 54.

Here, the embodiments of the present invention including all of the aspects of the embodiments disclosed here are examples and are not limitative. Scope of the invention is shown by the claims and not by the above descriptions, and the meanings equivalent to the claims and all of the modifications within the scope of the invention are included.

Figure 12:
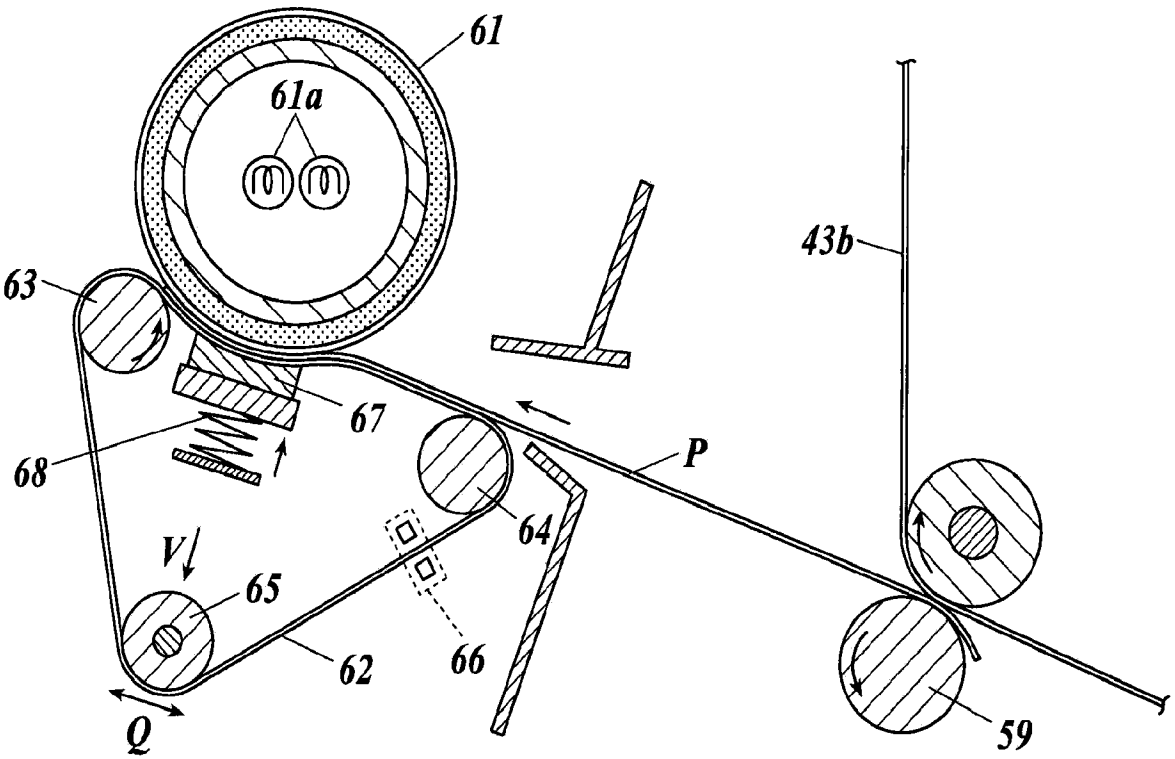
[FIG. 12] This is a detailed cross sectional diagram of a secondary transfer unit and a fixing unit of an image forming apparatus according to another embodiment.

In FIG. 12, a detailed cross sectional diagram of a secondary transfer unit and a fixing unit of an image forming apparatus of other embodiment is shown. Here, same symbols are used for structures which are similar to the structures of the above described embodiments and the descriptions are omitted.

For example, as shown in FIG. 12, the image forming apparatus of the other embodiment of the present invention may comprise a secondary transfer roller 59 or the like which forms a transfer nip which nips the paper P in cooperation with an intermediate transfer belt 43*b* instead of the secondary transfer belt 51 of the above embodiments. In this case, controlling of widthwise of the fixing belt 62 by controlling the change in rotation angle of the steering roller 65 is carried out and controlling of the change in rotation angle of the steering roller 54 which was similarly carried out with respect to the secondary transfer belt 51 will not be carried out.

Figure 13:
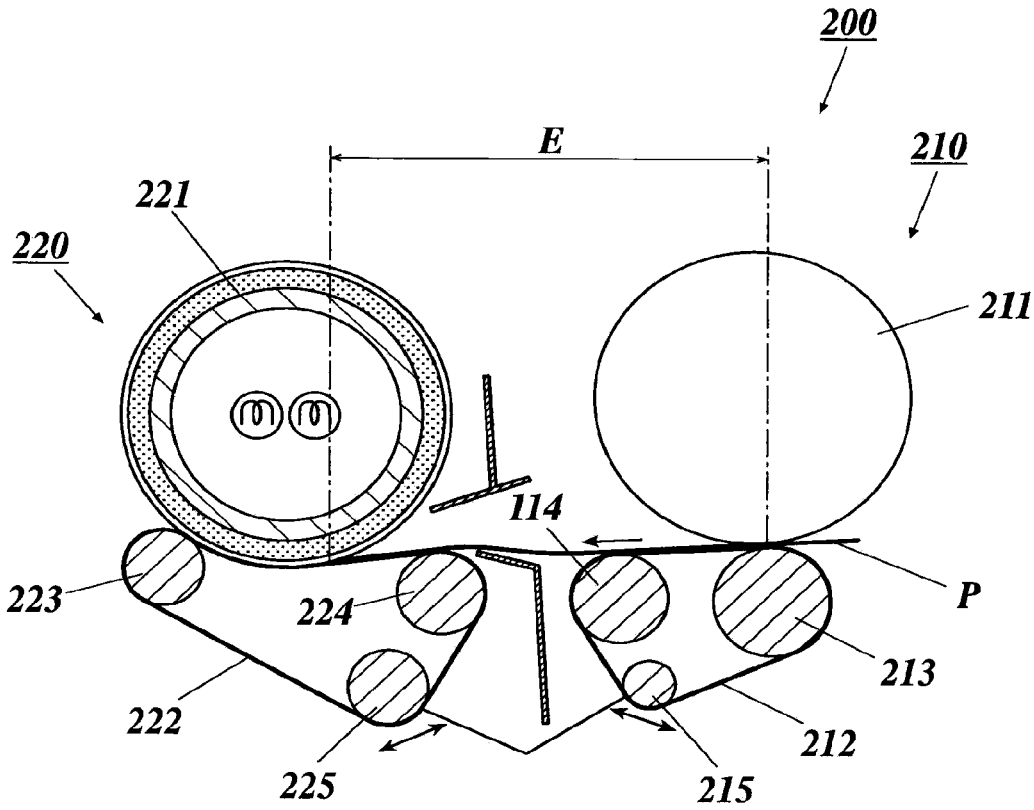
[FIG. 13] This is a diagram showing an outline of a transfer unit and a fixing unit of a conventional image forming apparatus.
Figure 14:
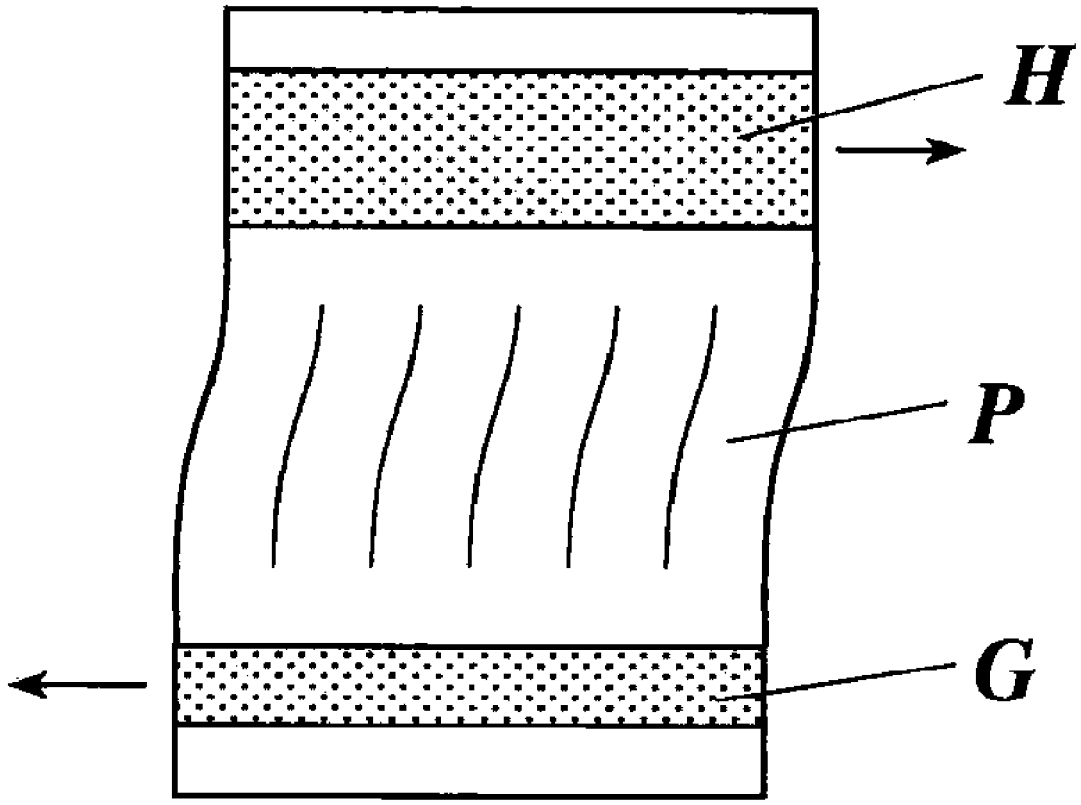
[FIG. 14] This is a diagram showing an example of a case where distortion occurs in a paper P.

Here, it is needless to mention that the structures of each unit of the image forming apparatus in the above described each embodiment can be replaced with other structure within the scope of the present invention. For example, there is suggested an image forming apparatus which applies other image carrier (for example, the photoreceptor drum shown in FIG. 13 or the like) instead of the intermediate transfer belt 43*b*.

The image forming apparatus may comprise other sensor instead of the photo sensor 66 for measuring the widthwise position of the fixing belt 62. For example, a sensor having a member which contacts an end of the widthwise of the fixing belt 62 and which can measure the widthwise position of the fixing belt 62 by whether there is contact to the member or not or the like may be applied. Further, the above described sensor and the photo sensor may be used together. The same applies to the photo sensor 55.

The paper position detection unit 80 is a photo sensor which detects the paper P which passes between the light emitting elements and the light receiving elements. However, it is needless to mention that other embodiments may be applied as long as presence/non-presence of the paper P can be recognized. For example, a structure where a lever member which is rotatable is provided at the conveyance passage of the paper P and where passing of the paper P is detected by the lever rotating in the conveyance direction of the paper P when the lever contacts the end of the paper P which is conveyed or the like may be applied.

In the image forming apparatus 1, one control unit 90 controls the change in rotation angle of both of the steering rollers 54 and 65. However, different control units for controlling the change in rotation angle of each of the steering rollers may be provided.

The various types of numerical values such as change in rotation angle of steering roller and rotation directions are examples, and it is needless to mention that they can be arbitrarily modified.

As long as the steering roller is provided so that the angle with respect to a belt (fixing belt, secondary transfer belt or the like) can be changed, the structure is not limited to the structure of the steering roller angel changing unit 70 in the above described embodiments. For example, a structure where both ends of the steering roller are provided so as to rotate opposing to each other and where the steering roller is made to rotate centering around the approximately center position of the both ends or the like can be applied.

Industrial Applicability

As described above, the image forming apparatus according to the present invention is effective not to cause distortion of the paper, and in particular, is suitable for achieving a good balance between controlling the belt position accurately and preventing distortion of paper.

EXPLANATION OF REFERENCE NUMERALS

51 Secondary transfer belt
54 steering roller
55 photo sensor
61 rotary fixing member
62 transfer belt
65 steering roller
66 photo sensor
70 steering roller angle changing unit
75, 76 stepping motor
80 paper position detection unit
90 control unit
93 ROM

The invention claimed is:

1. An image forming apparatus, comprising:

a transfer unit having a transfer nip, which is provided in an upstream side of a conveyance direction of a paper;

a fixing unit having a fixing nip of a fixing belt, which is provided in a downstream side of the conveyance direction;

a fixing belt position changing mechanism unit to change a widthwise position of the fixing belt; and a control unit to control the fixing belt position changing mechanism unit according to the widthwise position of the fixing belt, wherein the control unit can change widthwise position of the fixing belt when the paper is nipped by both of the transfer nip of the transfer unit and the fixing nip of the fixing unit at a same time and when the paper is not nipped by both of the transfer nip and the fixing nip at the same time; and when the paper is nipped by both of the transfer nip and the fixing nip at the same time, the control unit makes an amount of change in the widthwise position of the fixing belt smaller than that of when the paper is not nipped by both of the transfer nip and the fixing nip at the same time.

2. The image forming apparatus of claim 1, wherein when the paper is nipped by either one of the transfer nip of the transfer unit or the fixing nip of the fixing unit, the control unit makes the amount of change in the widthwise position of the fixing belt smaller than that of when the paper is not nipped by either of the transfer nip of the transfer unit and the fixing nip of the fixing unit.

3. The image forming apparatus of claim 1, wherein the fixing belt position changing mechanism unit includes a first steering roller to extend the fixing belt and the fixing belt position changing mechanism unit changes the widthwise position of the fixing belt by changing a rotation angle of the first steering roller.

4. The image forming apparatus of claim 1, comprising the transfer unit having the transfer nip of a transfer belt and a transfer belt position changing mechanism unit to change a widthwise position of the transfer belt, wherein the control unit can change the widthwise position of the transfer belt both when the paper is nipped by both of the transfer nip of the transfer unit and the fixing nip of the fixing unit at the same time and when the paper is not nipped by both of the transfer nip and the fixing nip at the same time; and when the paper is nipped by both of the transfer nip and the fixing nip at the same time, the control unit makes an amount of change in the widthwise position of the transfer belt smaller than that of when the paper is not nipped by both of the transfer nip and the fixing nip at the same time.

5. The image forming apparatus of claim 4, wherein when the paper is nipped by either one of the transfer nip of the transfer unit or the fixing nip of the fixing unit, the control unit makes the amount of change in the widthwise position of the transfer belt smaller than that of when the paper is not nipped by either of the transfer nip of the transfer unit and the fixing nip of the fixing unit.

6. The image forming apparatus of claim 4, wherein the transfer belt position changing mechanism unit includes a second steering roller to extend the transfer belt and the transfer belt position changing mechanism unit changes the widthwise position of the transfer belt by changing a rotation angle of the second steering roller.

7. The image forming apparatus of claim 1, wherein the transfer unit includes the transfer nip of a transfer roller.

* * * * *